United States Patent [19]

Temus

[11] Patent Number: 4,756,852

[45] Date of Patent: Jul. 12, 1988

[54] METHOD OF INSTALLING A VENT IN A NUCLEAR WASTE STORAGE SYSTEM

[75] Inventor: Charles J. Temus, Puyallup, Wash.

[73] Assignee: Nuclear Packaging, Inc., Federal Way, Wash.

[21] Appl. No.: 892,440

[22] Filed: Aug. 4, 1986

[51] Int. Cl.[4] ..... G21C 13/06; G21C 19/00

[52] U.S. Cl. ..... 252/633; 376/203; 376/260; 376/272; 376/456; 215/261; 220/DIG. 19; 220/303; 220/371; 250/506.1

[58] Field of Search ..... 376/272, 260, 203, 456; 252/633; 250/506.1, 507.1; 215/261; 220/371, DIG. 19, 303, 205, 367; 52/302

[56] References Cited

U.S. PATENT DOCUMENTS

| | | | |
|---|---|---|---|
| 3,315,831 | 4/1967 | Scott | 215/261 |
| 3,521,784 | 7/1970 | Gaines et al. | 215/261 |
| 3,557,989 | 1/1971 | Balda | 215/261 |
| 3,573,462 | 4/1971 | Wilkins et al. | 250/506.1 |
| 3,645,703 | 2/1972 | Frank et al. | 250/506.1 |
| 3,953,288 | 4/1976 | Johnson | 250/506.1 |
| 4,193,399 | 3/1980 | Robinson | 128/214.4 |
| 4,325,715 | 4/1982 | Bowman et al. | 55/158 |
| 4,445,042 | 4/1984 | Baatz et al. | 250/506.1 |
| 4,451,173 | 5/1984 | Watson et al. | 405/53 |
| 4,469,495 | 9/1984 | Hiraizumi et al. | 55/189 |

FOREIGN PATENT DOCUMENTS

| | | | |
|---|---|---|---|
| 3031211 | 3/1982 | Fed. Rep. of Germany | 250/506.1 |
| 3222764 | 12/1983 | Fed. Rep. of Germany | 250/506.1 |

*Primary Examiner*—Deborah L. Kyle
*Assistant Examiner*—Daniel Wasil
*Attorney, Agent, or Firm*—Christensen, O'Connor, Johnson & Kindness

[57] ABSTRACT

Disclosed is a method of installing a reversibly porous, air-diffusible, water-restrictive, polymer plug in a port that extends through the wall of a nuclear waste storage container. The plug is inserted a predetermined distance, for example, with the aid of a screwdriver applied to a slot in the plug's outer face. When inserted, the plug prevents the loss of nuclear waste through the port while the air-diffusible nature of the material allows gases to pass through the material. The resultant venting action of the plug prevents the creation of pressure differences between the interior of the container and the environment. Thus, the likelihood of the container becoming overpressurized and leaking is minimized. In addition, the water-restrictive nature of the plug material restricts the ingress and egress of water from the container, reducing the likelihood of groundwater contamination during storage. After insertion, a portion of the plug left projecting from the container's surface is removed, protecting the plug from external forces and tampering.

1 Claim, 1 Drawing Sheet

Fig. 1.
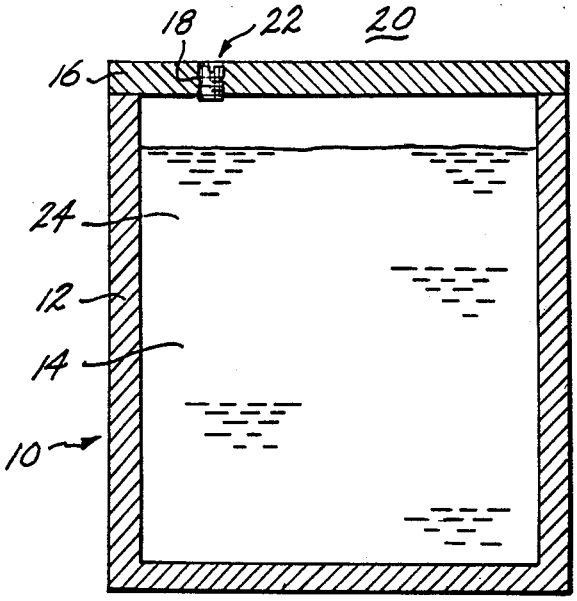
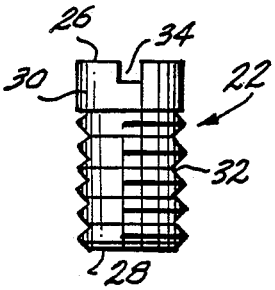
Fig. 2.
Fig. 3.
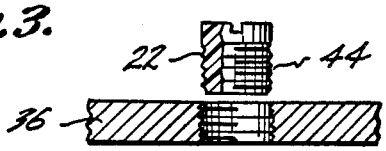
Fig. 4.
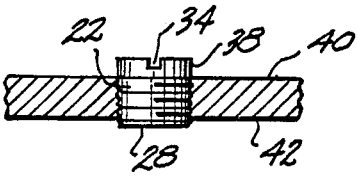
Fig. 5.
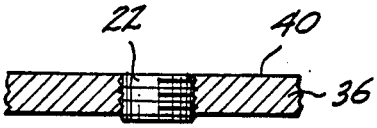

METHOD OF INSTALLING A VENT IN A NUCLEAR WASTE STORAGE SYSTEM

BACKGROUND OF THE INVENTION

This invention relates to systems for storing nuclear waste material and, more particularly, to apparatus for venting nuclear waste storage containers in a manner that allows gases generated by the stored waste material to escape, while simultaneously minimizing the intrusion of water.

One of the pressing problems currently facing society is the storage and disposal of nuclear waste. Given the magnitude and prolonged duration of the dangers inherent in storing nuclear waste, storage systems must satisfy exacting criteria over long periods of time. Thus, nuclear waste is generally stored in an impervious system specially designed for the application. A typical constraint on the design of such a system is that the waste must be contained, without leakage, for a period of 300 years. Development of a suitable storage system is further complicated by the variety of potential storage locations employed. For example, is frequently stored at the generation site initially. During this time, the storage container is accessible to personnel working at the site, making it susceptible to tampering or accidental damage. The container eventually may be buried at an underground site selected for its geological stability. Burial storage minimizes the likelihood of human interference with the stored waste. In most cases, clay, sand, rock, or salt burial sites are selected to provide a relatively dry storage environment for the container and to minimize the possibility of groundwater contamination. From the preceding discussion, it can be seen that successful storage of nuclear waste requires the system to be resistant to the effects of radiation, erosion, vibration, biodegradation, thermal cycling, burial loading forces, impact forces sustained by the container, and chemical action of the waste and environment on the container.

As noted, the specific problem of nuclear waste storage addressed by this invention is the venting of gas generated within the container. Should these gases cause the internal pressure of the container to become too great, the container structure could become overpressurized, allowing the stored waste to contaminate the environment. Three sources of gas generation within the container must be considered in order to realize a satisfactory venting system. First, the container material itself may generate gas when exposed to the radiation of its contents. Second, ion-exchange resins, which are used to reduce the radioactivity of fluids in nuclear power systems, may undergo radiolytic gas generation when stored in the container. Third, gas may be generated by the biodegradation of organic waste stored in the container (e.g., contaminated grease, solvents, oils, or organic materials attached to the ion-exchange resins). The rate at which gas is generated depends, among other things, on the total radiation dose exposure of the container and contents, the container and ion-exchange resin materials, the amount of organic waste present in the stored material, and the amount of oxygen within the container.

From the preceding discussion, it is clear that a precise determination of the amount of gas will be generated within the container would be difficult at best. Thus, given the need to ensure the structural integrity of the storage container under any set of conditions, a means for venting the interior of the container to the environment must be provided. In that manner, pressure differences between the interior of the container and the environment will be minimized, preventing the container from becoming overpressurized.

It is extremely doubtful that conventional venting devices can meet the design constraints for venting nuclear waste storage containers. For example, the natural venting characteristics of high-density polyethylene, as a container material, are generally incapable of producing the degree of venting required. Small check valves have good water restriction characteristics, but uncertainty exists as to their operation and ability to reseal over the 300-year design life of the container. Filters made of a porous metallic material would appear to have a number of drawbacks. First, their water restriction characteristics appear to be insufficient for nuclear waste storage container applications. Second, the material has a tendency to become wetted and trap water, greatly increasing the pressure required to pass gases through the material. Finally, the use of a metallic material can establish a galvanic couple between the container and the filter and lead to corrosive failure. Activated charcoal filters, while noncorrosive, resistant to gamma radiation, and readily available, generally have a low resistance to the ingress of water.

SUMMARY OF THE INVENTION

In accordance with the invention, there is provided a passive vent having as its primary component a reversibly porous, air-diffusible, water-restrictive, polymer plug secured in a port provided in the wall of the container. The air-diffusible nature of the material allows gases to flow through the plug in both directions. Thus, variations in pressure between the inside of the container and the container environment may be relieved. In the presence of water, water flow through the plug is restricted by a swelling of the plug material, minimizing the possibility of groundwater contamination from the waste stored in the container. The degree of waterflow restriction exhibited by the plug is directly proportional to the amount of water retained by the plug. Airflow through the plug is also inhibited in direct proportion to the amount of water retained in the plug. Even with the plug material saturated with water, however, some venting takes place. In addition, the reversible porosity of the material allows the reduction in air-diffusibility of the material attendant liquid saturation to be reversed by allowing the material to dry. The characteristics of the plug material selected also include a high resistance to the effects of radiation, chemicals, corrosion, biodegradation, and thermal cycling. A means for securing the plug in the wall of the housing is provided that will ensure plug retention in the wall over the life of the system even when subject to environmental effects, such as vibration. Finally, in the currently preferred embodiments, a sealing means, impervious to the flow of both gas and liquid, is placed between the wall of the port, and the plug.

In these currently preferred embodiments the plug material is a low-density, linear porous polyethylene having an average pore diameter of less than 5 microns. Threads provided on the sides of the plug for engagement with similar threads provided in the container wall port constitute the means for securing the plug in the container wall. A thread sealant is applied to the threads.

In the preferred embodiments, the plug has a cross-sectional area of less than 0.5 square inch (approximately 3.2 square centimeters), limiting the size of the port required to be made in the wall of the housing. Thus, even if the vent should fail, the constrictive effect of the relatively small port cross section will minimize the ingress and egress of liquids, protecting the environment. The plug also has an outer portion that includes means (such as a screwdriver slot) for receiving a tool capable of driving the plug into the port until the plug is properly seated. This outer portion of the plug constitutes an excess region that protrudes from the outer wall of the container when the plug is inserted. After insertion, this excess region is removed, minimizing the possibility that the plug will be tampered with or subject to forces incurred by the container wall from the environment. Additionally, with the portion of the plug containing the means for receiving the insertion tool removed, there are no depressions on the plug surface to collect water. A slight protrusion of material may also be left to minimize the collection of groundwater around the vent.

According to the invention, a process for installing the plug in the wall of the housing is revealed. The process consists of applying a sealant to the threads of the plug, inserting the plug a predetermined distance in a port provided in the wall of the housing, and removing the excess portion of the plug protruding from the wall of the housing.

BRIEF DESCRIPTION OF THE DRAWINGS

The invention will presently be described in greater detail, by way of example, with reference to the accompanying drawings, wherein:

FIG. 1 is a cross-sectional view of a nuclear waste storage container employing the passive vent of the invention, the passive vent being shown in enlarged scale relative to the container for clarity;

FIG. 2 is a pictorial view of one arrangement of the plug showing the use of threads as a means for securing the plug in a port provided in the wall of the container;

FIG. 3 is a cross-sectional view of the portion of the container wall containing the port, including a partial sectional view of one embodiment of the plug disposed above the port for insertion thereinto, the plug including threads as a means for securing the plug in the port and an excess region containing a means for inserting the plug in the port;

FIG. 4 is a view similar to that of FIG. 3, showing the plug inserted in the port provided in the container wall; and FIG. 5 is a view similar to that of FIG. 4, showing the excess region of the plug removed after insertion of the plug into the port.

DETAILED DESCRIPTION OF THE INVENTION

FIG. 1 illustrates the passive vent employed in a nuclear waste storage container 10. The nuclear waste storage container 10 consists of a cask 12 open on one end. A cover 16 is secured and sealed to the open end of cask 12 so that the cask 12 and cover 16 define a nuclear waste storage chamber 14. In FIG. 1, a port 18 is shown located in the cover 16, defining a passageway between the chamber 14 and the environment 20 that surrounds the nuclear waste storage container 10. A vent plug 22, described in greater detail below, is inserted in port 18, passively venting nuclear waste storage container 10. The nuclear waste 24, however, is effectively confined within chamber 14, protecting the environment 20 from the effects of the nuclear waste 24. Pressure differences between the environment 20 and chamber 14, created by temperature changes or gas generation within the chamber 14, are relieved by vent plug 22, preventing an overpressurization of the nuclear waste storage container 10.

While FIG. 1 shows vent plug 22 located in the cover 16, a passive vent may be formed by placing vent plug 22 in a port 18 provided in any of the walls of container 10. It should be noted, however, that maximum air diffusion through vent plug 22 occurs when port 18 is located above the level of nuclear waste 24 in the chamber 14. For that reason, the location of port 18 in the cover 16, as shown in FIG. 1, is often preferred as a convenient arrangement for ensuring maximum air diffusion.

The passive vent system illustrated in FIG. 1 additionally shows vent plug 22 recessed in port 18. In this manner, the vent plug 22 is protected from physical damage should the nuclear waste storage container 10 be dropped or struck by an object during shipping or handling.

FIG. 2 is a pictorial view illustrating the vent plug 22 of FIG. 1 in greater detail. The body of vent plug 22 is substantially cylindrical and has an external face 26 that is exposed to the environment 20 when vent plug 22 is installed in port 18. Similarly, vent plug 22 has an internal face 28 that is exposed to the chamber 14 upon insertion of vent plug 22 in the port 18. A substantially cylindrical contact face 30 completes vent plug 22, connecting external face 26 to internal face 28 and difining a surface that contacts the wall of port 18 when plug 22 is installed in port 18.

The vent plug 22 is formed from a reversibly porous, air-diffusible, water-restrictive polymer capable of properly venting the chamber 14 and enduring the rigors imparted by the environment 20 of the container 10 and the waste 24 stored therein. Low-density, linear porous polyethylene has been found acceptable for this purpose and the currently preferred material for vent plug 22 is available from General Polymeric Co., 621 Franklin Street, West Reading, Pa. 19611, under the trademark QUICKUP, part number 200-12A.

Selection of porous polyethylene as the plug material provides a number of advantages. First, polyethylene is relatively resistant to the effects of nuclear radiation. For example, polyethylene is reported to maintain 80 percent of its strength when subject to a radiation level of $10^9$rads. Even when the strength of the polyethylene is impaired, the most significant effect is on the material's ability to tolerate deformation. Because the vent plug 22 is subject to litte or no deformation, and because the radiation in a typical storage system is on the order of $10^8$rads, or less, polyethylene can endure the effects of the radiation emitted by the nuclear waste 24 stored within chamber 14.

Polyethylene also has the chemical resistance required of a vent plug 22. Polyethylene is highly resistant to deterioration from inorganic materials. While it is less resistant to the influence of organic materials, these materials are unlikely to occur in concentrations sufficient to cause deterioration of the vent. In addition, deterioration occurring as a result of the absorportion of organic material into the polyethylene simply softens or weakens the material. Thus, even if some deterioration occurred, the resultant decrease in vent strength would not be critical because vent plug 22 is not subject to significant loading.

The use of polyethylene also satisfies various other environmental criteria imposed on passive vents for use with nuclear waste storage containers 10. Galvanic coupling with the wall of nuclear waste storage container 10, as well as corrosion, is eliminated. The vent plug 22, so comprised, has also proved satisfactory in withstanding the loading effects of the pressure developed within chamber 14 and the burial and compressive loads imposed by the environment 20. Finally, the plug 22 remains securely in place when the waste storage container 10 is exposed to vibration and when container 10 is dropped from heights simulating potential impacts that might be experienced during shipping and handling.

The requirement that the vent allow air to flow through plug 22, while simultaneously restricting the flow of liquids, is satisfied by the reversibly porous, air-diffusible, water-restrictive nature or the material. The vent, constructed from such material, allows gases generated within chamber 14 to escape to the environment 20, preventing overpressurization of container 10. These gases include hydrogen, oxygen, carbon dioxide, carbon monoxide, nitrogen, and methane, generated by the polyethylene material, ion-exchange resins, and wastes stored in the container. If the environment 20 is at a higher pressure than chamber 14, air may also diffuse into chamber 14 through vent plug 22. The pressure of environment 20 and chamber 14 are, thus, equalized, relieving any stress placed on the walls of nuclear waste storage container 10.

As noted, such a vent plug 22 also restricts the flow of liquids. The magnitude of the restrictive effect is proportional to the amount of liquid present in the plug 22. The liquid causes the material to swell and, because the cross-sectional area of plug 22 is constrained by port 18, the effective porosity of the material decreases. Thus, while some flow of liquids through vent plug 22 is possible, it becomes severely restricted when the entire plug 22 is saturated. In this condition, the diffusibility of the material to air is also reduced. The resultant airflow, however, is sufficient for the vent to remain operative. An added benefit is provided by the reversibly porous nature of the material, which allows a vent, once saturated, to regain its orginally high air-diffusibility when dried.

The water-restrictive nature of plug 22 restricts the escape of nuclear waste 24 in liquid form through the passive vent. Thus, although the nuclear waste storage container 10 is generally intended for storage at dry locations, groundwater present around the container is protected from contamination by the waste stored in container 10. This is true even though a continuous communication between chamber 14 and external environment 20 is provided to relieve pressure variations between the two.

The average porosity of the material utilized in plug 22 is selected in view of several factors. The pore size of the material is generally inversely proportional to the cross-sectional area of the vent plug 22 required to obtain a given amount of venting. Thus, relatively small pores may require use of a correspondingly large vent plug 22. While larger pores enhance the venting of container 10, the ability of vent plug 22 to restrict the flow of liquids is impaired. In the preferred embodiment, an average pore diameter of one micron, employed in a vent plug having a cross-sectional area of less than 0.5 square inch (approximately 3.2 square centimeters), has been found suitable. A cross-sectional area of less than 0.5 square inch is desirable for vent plug 22 because, in the unlikely event vent plug 22 is displaced from port 18, the resultant opening formed by port 18 in the container wall will be relatively small. While liquids would be free to transfer between the environment 20 and chamber 14 of nuclear waste storage container 10 in this condition, the restrictive effect of the reduced opening would keep such transfer at a minimum.

FIG. 2 also indicates the manner in which the currently preferred embodiments of vent plug 22 are secured to the wall of port 18. In FIG. 2, the contact face 30 of vent plug 22 is provided with threads 32 that engage with mating threads provided in the wall of port 18. A means 34 for receiving a tool for driving vent plug 22 into port 18 is provided on the external face 26 of vent plug 22. As illustrated in FIG. 2, one suitable means 34 is a slot for a screwdriver bit. Other means of receiving an insertion tool capable of inducing rotation of vent plug 22 include, for example, a female depression for use with an allen wrench or Phillips head screwdriver.

FIG. 3 illustrates one embodiment of vent plug 22 prior to insertion in a wall 36 of nuclear waste storage container 10. Vent plug 22 has a cylindrical height or thickness that is greater than the thickness of wall 36. The excess thickness roughly defines an excess region 38 of vent plug 22 that extends beyond the external surface 40 of wall 36 when vent plug 22 is properly seated in wall 36 (FIG. 4). From FIG. 4, it is clear that the means 34 for receiving an insertion tool lies within this excess region 38. Excess region 38 can be removed from vent plug 22 in a manner leaving an exposed surface of vent plug 22 that is substantially flush with (or protrudes slightly from) the external surface 40 of wall 36 (FIG. 5). In this manner, a vent installed in a nuclear waste storage container 10 having a relatively thin wall 36 may be protected both from tampering and from environmental forces incurred by the container wall 36.

With the means 34 for receiving the insertion tool removed, vent plug 22 cannot be easily removed by unauthorized personnel. Thus, tampering with the passive vent is reduced. Additionally, groundwater cannot collect in the means 34. Because the exterior of the passive vent lies substantially flush with the external surface 40 of wall 36, any impact or other force on wall 36 is distributed to the wall 36 rather than directly to vent plug 22, protecting the plug.

Preferably, vent plug 22 is sealed within port 18 to ensure that neither liquid nor gas passes between contact face 30 of plug 22 and the walls of port 18. As indicated in FIG. 3, a thread sealant 44 that is impervious to gas and liquid can be applied to contact surface 30 for compression between the contact surface and port 18 when vent plug 22 is installed. One such sealant tape is formed of a fluorocarbon resin that is commonly known as "Teflon" (a trademark of E.I. duPont de Nemours & Company).

From the preceding discussion, it can be recognized that the invention provides a method of forming a passive vent in a nuclear waste storage container. Pursuant to this method, a vent plug is formed in the manner, and of the material, described herein. If necessary, a sealant is applied to the vent plug 22 prior to installation in port 18 to prevent gas or liquid from passing around the vent plug.

Next, vent plug 22 is inserted in port 18 of wall 36 by applying an insertion tool to the receiving means 34 of vent plug excess region 38. Vent plug 22 is then inserted a predetermined distance, for example, until the interal face 28 of vent plug 22 extends slightly beyond the internal surface 42 of wall 36 as shown in FIG. 4 or until vent plug 22 is properly seated. At this point, the excess region 38 of vent plug 22 is removed, leaving a passive vent as shown in FIG. 5. As noted previously, the resulting vent is subject to a reduced likelihood of collecting water, being tampered with by unauthorized personnel, or damaged from forces exerted upon the external surface 40 of wall 36 by foreign objects. Vent plug 22, after this step, may optionally protrude slightly from the external surface 40 of wall 36 to prevent water from accumulating at port 18.

It is to be understood that the invention may be practiced with other specific forms of apparatus without departing from the spirit or basic characteristics of the invention. For example, the body of the vent plug may be shaped like a cylinder, polyhedron or frustum of a cone. Similarly, the location of the plug in the wall of the housing, while providing optimal venting when above the waste level in the container, can be anywhere. Alternative means of securing the vent plug in the container wall may be employed. The scope of the invention is, therefore, to be determined by the appended claim rather than by the drawings and foregoing description.

The embodiments of the invention in which an exclusive property or privilege is claimed are defined as follows:

1. A method of installing a vent in a nuclear waste storage container, which comprises the steps of:

inserting a reversibly porous, air-diffusible, water-restrictive polymer plug, having an internal face, an external face, and a contact face connecting said internal face to said external face, a predetermined distance into a port formed in a wall of said container, said plug also provided with a means for securing said plug in said port, a means for sealing said contact face against a closed wall defined by said port in said wall of said container, and a means for receiving an insertion tool, located in an excess region of said plug adjacent said external face of said plug; and removing said excess portion of said plug protruding from said container wall after said step of inserting is completed, making it difficult to tamper with said vent when installed and providing a minimal area of exposure of said plug above said wall, protecting said plug from damage by external forces.

* * * * *